US008979577B2

(12) United States Patent
Wu

(10) Patent No.: US 8,979,577 B2
(45) Date of Patent: Mar. 17, 2015

(54) BRIDGING TERMINAL

(71) Applicant: Dinkle Enterprise Co., Ltd., New Taipei (TW)

(72) Inventor: Shang Tsai Wu, Taipei (TW)

(73) Assignee: Dinkle Enterprise Co., Ltd., New Taipei ( * ) Notice: Subject to any disclaimer, the term of this patent is extended or adjusted under 35 U.S.C. 154(b) by 109 days.

(21) Appl. No.: 13/925,188

(22) Filed: Jun. 24, 2013

(65) Prior Publication Data

US 2014/0377984 A1 Dec. 25, 2014

(51) Int. Cl.
*H01R 31/08* (2006.01)
*H01R 9/24* (2006.01)

(52) U.S. Cl.
CPC ..... *H01R 9/2491* (2013.01)
USPC ..... 439/507; 439/76.2

(58) Field of Classification Search
USPC ..... 439/507–514, 76.2
See application file for complete search history.

(56) References Cited

U.S. PATENT DOCUMENTS

| | | | | |
|---|---|---|---|---|
| 4,726,787 | A * | 2/1988 | Stine | 439/510 |
| 5,274,918 | A * | 1/1994 | Reed | 29/882 |
| 5,669,788 | A * | 9/1997 | Brockman | 439/511 |
| 6,402,548 | B1 * | 6/2002 | Ruiz et al. | 439/507 |
| 2005/0095904 | A1 * | 5/2005 | Reibke et al. | 439/507 |
| 2012/0329315 | A1 * | 12/2012 | Hanses | 439/507 |
| 2014/0057483 | A1 * | 2/2014 | Reineke | 439/507 |

* cited by examiner

*Primary Examiner* — Truc Nguyen
(74) *Attorney, Agent, or Firm* — Birch, Stewart, Kolasch & Birch, LLP

(57) ABSTRACT

A bridging terminal includes a cap and four conductive pieces. Each of the flexible conductive pieces has two pin portions and a connecting portion. The connecting portions are combined in an assembling chamber of the cap. The pin portion of the first flexible conductive piece has a front-left-outer facet and a front-right-outer facet jutting frontward, and has a flexible arch jutting backward. The second and third flexible conductive pieces have each of their pin portions including a left-outer facet, a right-outer facet and a slot. The pin portion of the fourth flexible conductive piece has a rear-left-outer facet and a rear-right-outer facet jutting backward, and has a flexible arch jutting frontward. When the flexible conductive pieces are aligned and piled, the flexible arches are received in the corresponding slots. Thereby, the bridging terminal provides improved electric conductivity, bonding strength and stability, while preventing elastic fatigue and premature failure.

4 Claims, 7 Drawing Sheets

BRIDGING TERMINAL

BACKGROUND OF THE INVENTION

1. Technical Field

The present invention relates to bridging terminals, and more particularly, to a bridging terminal helpful to increase the contacting area and contacting points, so as to improve electric conductivity, bonding strength and stability, while preventing elastic fatigue and premature failure.

2. Description of Related Art

It can be easily seen in an average electronic appliance that multiple transmission lines are used for signal transmission. For connecting electronic devices, transmission lines are collected at a terminal and such terminals of individual electronic devices are connected with each other, such that signals can be transmitted among these electronic devices.

Moreover, in the level of electronic devices, if it is appropriate, a bridging terminal may be provided for connecting (bridging) two terminals in order to, for example, create a short circuit between the two terminals.

An existing bridging terminal is a reversed-U shaped member formed by a single flexible conductive piece. When bridging two terminals, the bridging terminal provides a modest contacting area with the two terminals, resulting in unsatisfactory electric conductivity and poor bonding strength, which means that the bridging terminal and the two terminals are likely to come off from each other, and that the stability of the bridging terminal is compromised.

At last, to bridge the two terminals with an existing bridging terminal, a user has to exert force on the bridging terminal to make its pin portions deform so as to be allowed to engage with sockets on the two terminals. However, in the case where the users' force is large to the extent that the bridging terminal has elastic fatigue (fatigue deformation), the bridging terminal will become unusable.

BRIEF SUMMARY OF THE INVENTION

In the present invention, a bridging terminal disclosed comprises a cap, a first flexible conductive piece, a second flexible conductive piece, a third flexible conductive piece and a fourth flexible conductive piece.

The cap has therein an assembling chamber. The first flexible conductive piece is a reversed-U shaped member that comprises a first connecting portion and at least two first pin portions. The first connecting portion serves to connect the at least two first pin portions. Each of the first pin portions has a front-left-outer facet and a front-right-outer facet jutting frontward, and further has a first flexible arch jutting backward. The front-left-outer facet and the front-right-outer facet are at two opposite ends of the first flexible arch. The second flexible conductive piece is a reversed-U shaped member that comprises a second connecting portion and at least two second pin portions. The second connecting portion serves to connect the at least two second pin portions. Each of the second pin portions has a first left-outer facet and a first right-outer facet, and also has a first slot. The third flexible conductive piece is a reversed-U shaped member that comprises a third connecting portion and at least two third pin portions. The third connecting portion serves to connect the at least two third pin portions. Each of the third pin portions comprises a second left-outer facet and a second right-outer facet, and also has a second slot. The fourth flexible conductive piece is a reversed-U shaped member that comprises a fourth connecting portion and at least two fourth pin portions. The fourth connecting portion serves to connect the at least two fourth pin portions. Each of the fourth pin portions has a rear-left-outer facet and a rear-right-outer facet jutting backward and further has a second flexible arch jutting frontward. The rear-left-outer facet and the rear-right-outer facet are at two opposite ends of the second flexible arch.

When the first flexible conductive piece, the second flexible conductive piece, the third flexible conductive piece and the fourth flexible conductive piece are aligned and piled together, the first connecting portions, the second connecting portions, the third connecting portions and the fourth connecting portions are correspondingly piled and combined in the assembling chamber. The at least two first pin portions, the at least two second pin portions, the at least two third pin portions and the at least two fourth pin portions are also correspondingly piled such that the first flexible arches are received in the first slots, and the second flexible arches are received in the second slots.

With the foregoing configuration, the disclosed bridging terminal can increase contacting area and contacting points, so as to improve electric conductivity, bonding strength and stability, while preventing elastic fatigue and premature failure.

The cap may have two opposite recessed portions for users' easy holding. With the recessed portions, users can easily exert force on the cap, so as to hold and remove the bridging terminal.

The first slot may have a T-shaped cross-section. Similarly, the second slot may also have a T-shaped cross-section.

DETAILED DESCRIPTION OF THE INVENTION

Figure 1:
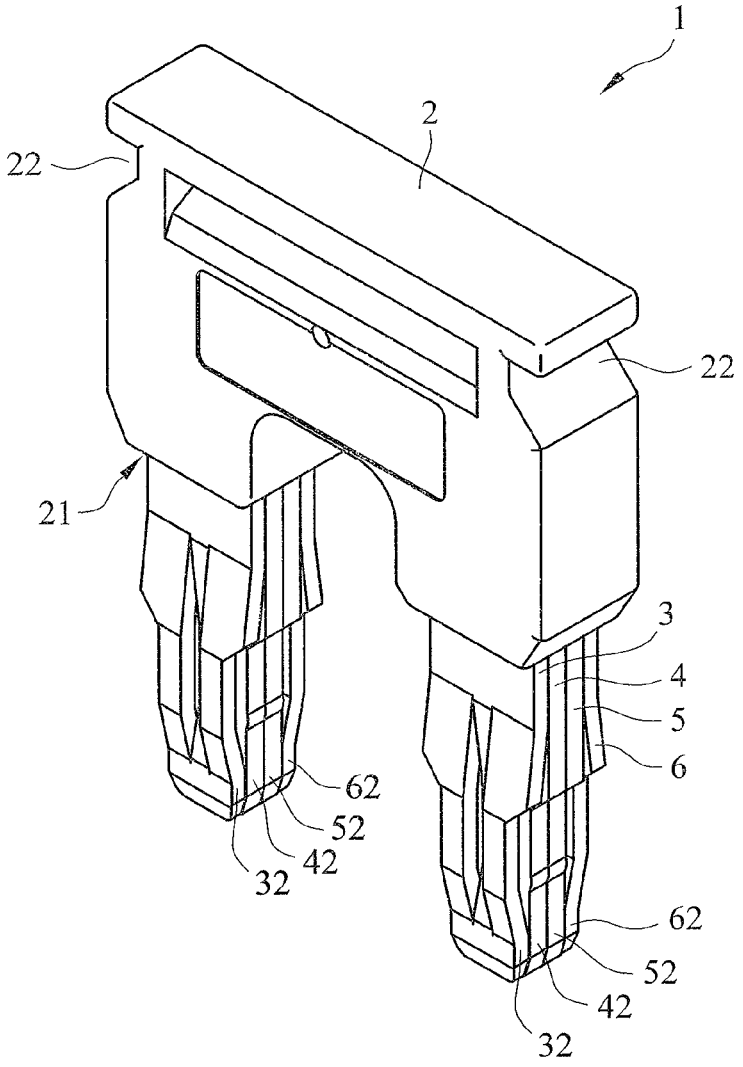
FIG. 1 is a perspective view of a first preferred embodiment of the present invention.
Figure 2:
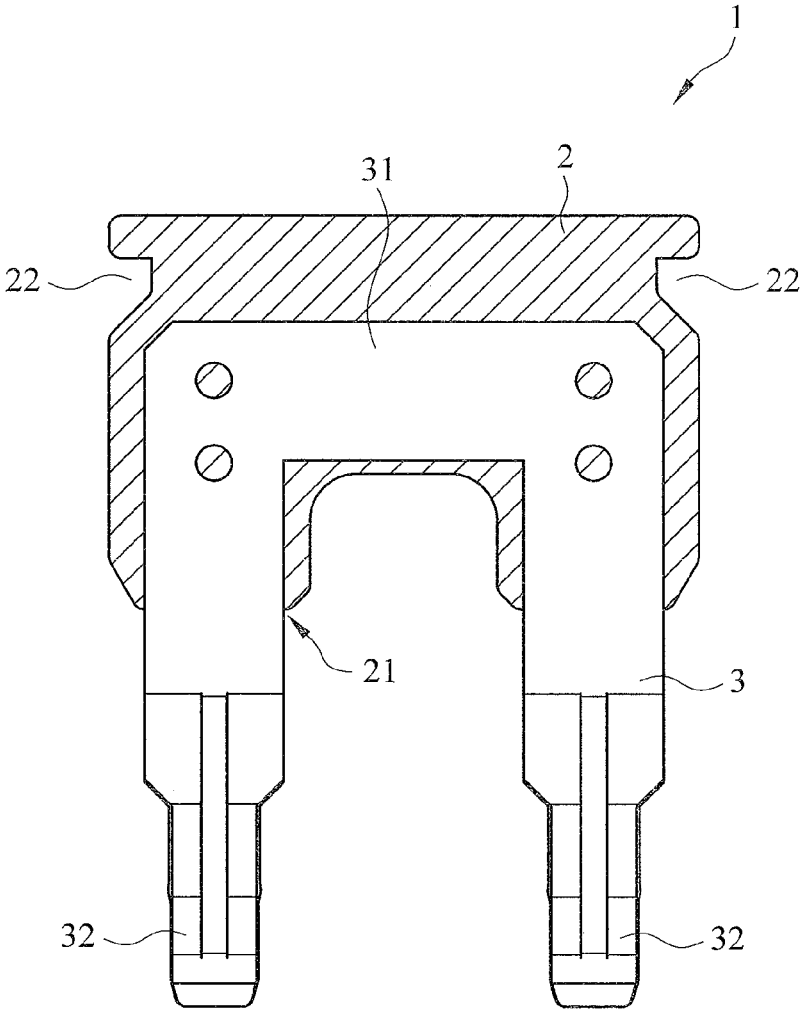
FIG. 2 is a cross-sectional view of the first preferred embodiment of the present invention.

Refer now to FIG. 1 and FIG. 2, which are a perspective view and a cross-sectional view of a first preferred embodiment of the present invention, respectively.

As shown, the disclosed bridging terminal 1 comprises a cap 2, a first flexible conductive piece 3, a second flexible conductive piece 4, a third flexible conductive piece 5 and a fourth flexible conductive piece 6.

Figure 3:
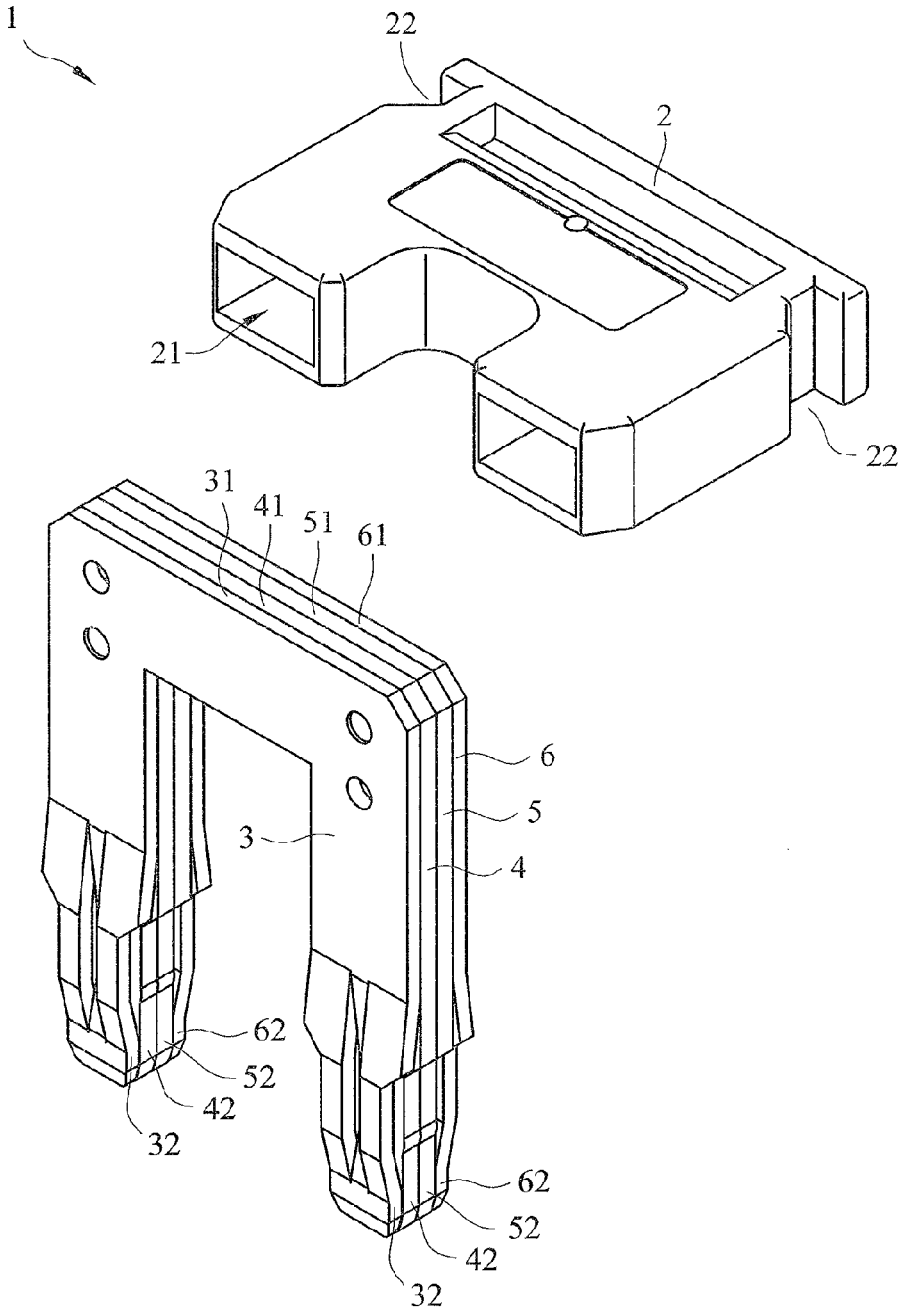
FIG. 3 is an exploded view of the first preferred embodiment of the present invention, showing a cap and flexible conductive pieces.

Now refer to FIG. 3, which is an exploded view of the first preferred embodiment of the present invention, showing the cap and the flexible conductive pieces, and also refer to FIG. 1 and FIG. 2.

As shown in FIG. 3, the cap 2 comprises an assembling chamber 21, such that the first flexible conductive piece 3, the second flexible conductive piece 4, the third flexible conductive piece 5 and the fourth flexible conductive piece 6 when piled together can be received in the assembling chamber 21 of the cap 2, as shown in FIG. 1 and FIG. 2. The details of the components will be given below.

Figure 4:
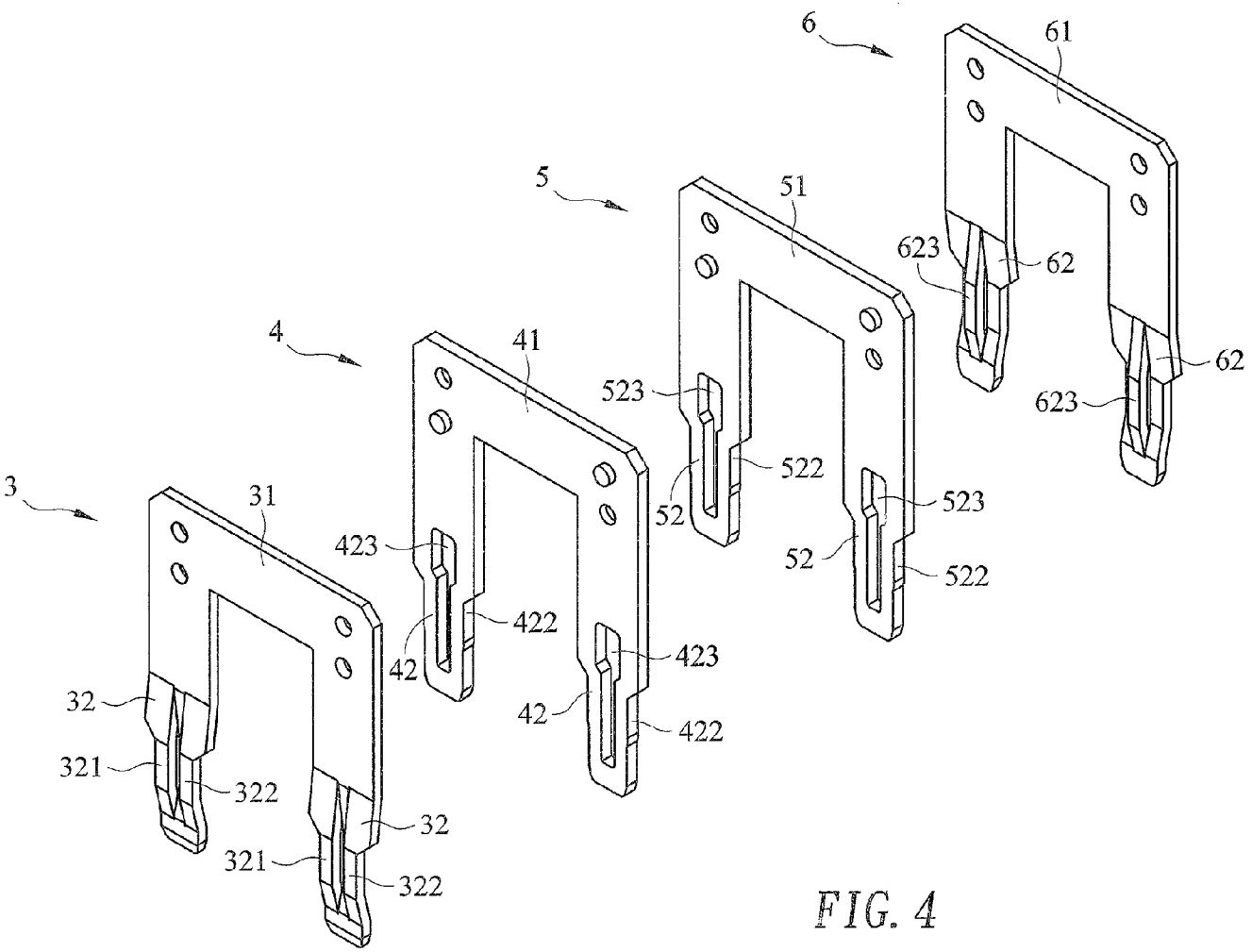
FIG. 4 is an exploded view of the flexible conductive pieces, taken from a front-to-back viewpoint.
Figure 5:
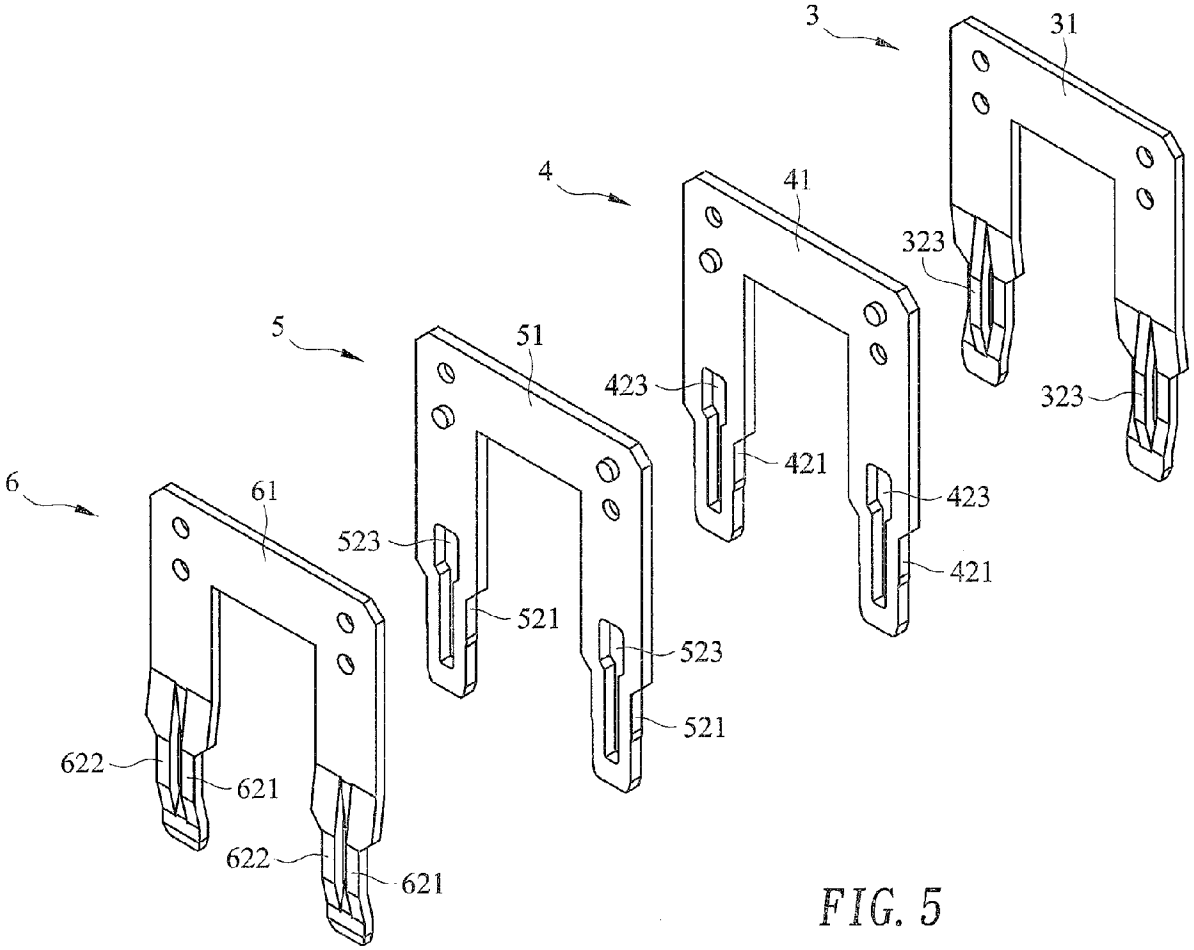
FIG. 5 is another exploded view of the flexible conductive pieces, taken from a back-to-front viewpoint.

Now refer to FIG. 4 and FIG. 5 together, which are exploded views of the flexible conductive pieces taken from a front-to-back viewpoint and from a back-to- front viewpoint, respectively.

As can be seen in FIG. 4 and FIG. 5, the first flexible conductive piece 3 is a reversed-U shaped member that comprises a first connecting portion 31 and two first pin portions 32. The first connecting portion 31 serves to connect the two first pin portions 32. Each of the first pin portions 32 has a front-left-outer facet 321 and a front-right-outer facet 322 jutting frontward, and has a first flexible arch 323 jutting backward. The front-left-outer facet 321 and the front-right-outer facet 322 are at two opposite ends of the first flexible arch 323. The second flexible conductive piece 4 is also a reversed-U shaped member that comprises a second connecting portion 41 and two second pin portions 42. The second connecting portion 41 serves to connect the two second pin portions 42. Each of the second pin portions 42 has a first left-outer facet 421 and a first right-outer facet 422, and is formed with a first slot 423. The third flexible conductive piece 5 is also a reversed-U shaped member that comprises a third connecting portion 51 and two third pin portions 52. The third connecting portion 51 serves to connect the two third pin portions 52. Each of the third pin portions 52 has a second left-outer facet 521 and a second right-outer facet 522, and is formed with a second slot 523. The fourth flexible conductive piece 6 is also a reversed-U shaped member that comprises a fourth connecting portion 61 and two fourth pin portions 62. The fourth connecting portion 61 serves to connect the two fourth pin portions 62. Each of the fourth pin portions 62 has a rear-left-outer facet 621 and a rear-right-outer facet 622 jutting backward, and has a second flexible arch 623 jutting frontward. The rear-left-outer facet 621 and the rear-right-outer facet 622 are at two opposite ends of the second flexible arch 623.

As shown in FIG. 1 through FIG. 5, the first flexible conductive piece 3, the second flexible conductive piece 4, the third flexible conductive piece 5 and the fourth flexible conductive piece 6 are piled together. The first connecting portion 31, the second connecting portion 41, the third connecting portion 51 and the fourth connecting portion 61 are aligned so that they are stacked in the assembling chamber 21 of the cap 2. The two first pin portions 32 of the first flexible conductive piece 3, the two second pin portions 42 of the second flexible conductive piece 4, the two third pin portions 52 of the third flexible conductive piece 5 and the two fourth pin portions 62 of the fourth flexible conductive piece 6 are correspondingly piled, respectively. At this time, the first flexible arches 323 of the first flexible conductive piece 3 are received in the first slots 423 of the second flexible conductive piece 4, and the second flexible arches 623 of the fourth flexible conductive piece 6 are received in the second slots 523 of the third flexible conductive piece 5.

Figure 6:
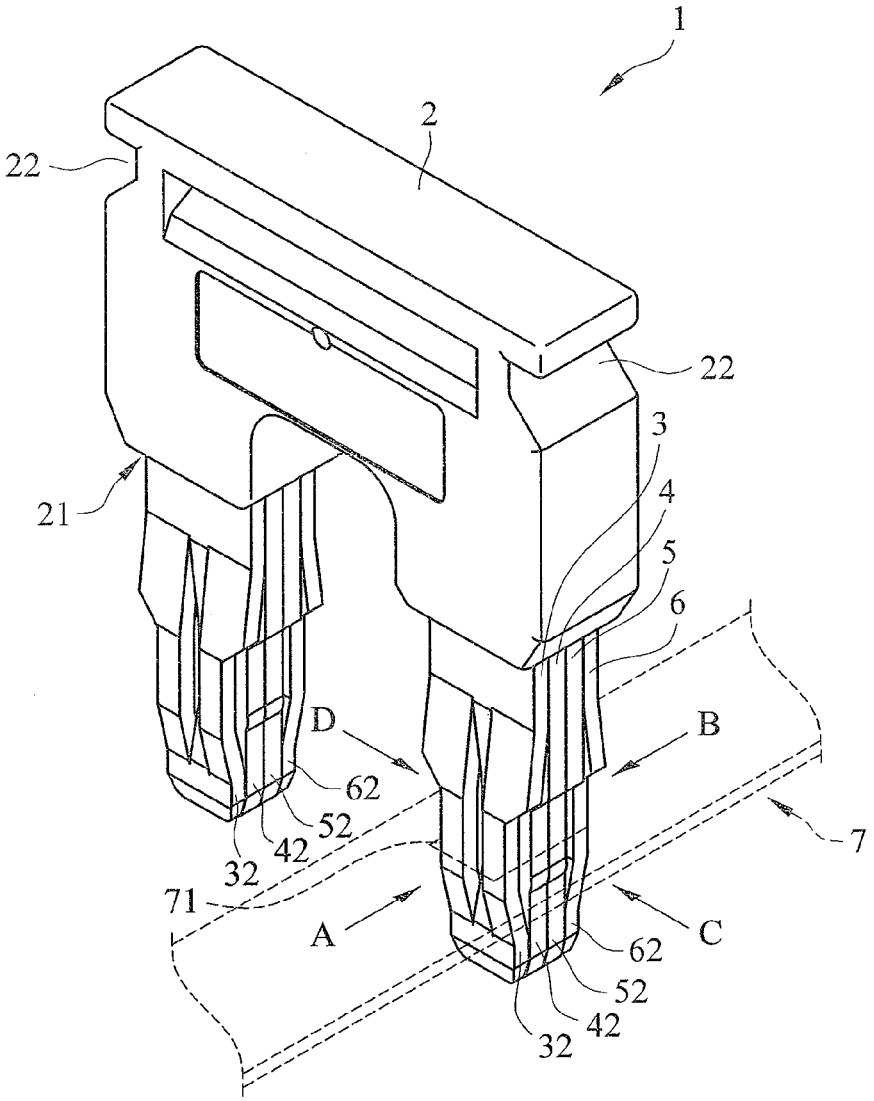
FIG. 6 is an applied view of the first preferred embodiment of the present invention.

Refer now to FIG. 6, which is an applied view of the first preferred embodiment of the present invention, and also refer to FIG. 1, FIG. 4 and FIG. 5.

In use, for an instance where the bridging terminal 1 is to be inserted into a terminal rail 7 for creating a short circuit, the aligned and piled first pin portions 32 of the first flexible conductive piece 3, the second pin portions 42 of the second flexible conductive piece 4, the third pin portions 52 of the third flexible conductive piece 5 and the fourth pin portions 62 of the fourth flexible conductive piece 6 are inserted into an opening 71 of the terminal rail 7.

At this time, as shown, the front-left-outer facets 321 and the front-right-outer facets 322 of the first pin portions 32 of the first flexible conductive piece 3, the first left-outer facets 421 and the first right-outer facets 422 of the second pin portions 42 of the second flexible conductive piece 4, the second left-outer facets 521 and the second right-outer facets 522 of the third pin portions 52 of the third flexible conductive piece 5, and the rear-left-outer facets 621 and the rear-right-outer facets 622 of the fourth pin portions 62 of the fourth flexible conductive piece 6 come to abut against the terminal rail 7. In other words, each pin portions of the bridging terminal 1 has totally eight contacting surfaces (the front-left-outer facet 321, the front-right-outer facet 322, the first left-outer facet 421, the first right-outer facet 422, the second left-outer facet 521, the second right-outer facet 522, the rear-left-outer facet 621 and the rear-right-outer facet 622) contacting with the terminal rail 7. As such, the contacting area between each of the pin portions of the bridging terminal 1 and the terminal rail 7 is increased, thereby providing improved electric conductivity.

In addition, as shown, when the pin portions of the bridging terminal 1 (referring to the assembly of the first pin portions 32 of the first flexible conductive piece 3, the second pin portions 42 of the second flexible conductive piece 4, the third pin portions 52 of the third flexible conductive piece 5 and the fourth pin portions 62 of the fourth flexible conductive piece 6) are about to be inserted into the opening 71 of the terminal rail 7, the pin portions of the bridging terminal 1 may perform deformation in four directions as indicated by A, B, C and D in FIG. 6. Thus, upon insertion of the pin portions of the bridging terminal 1 into the opening 71 of the terminal rail 7, the bonding strength between the pin portions of the bridging terminal 1 and the wall of the opening 71 of the terminal rail 7 can be increased, securing the both from coming off from each other, so as to ensure firm combination and stability (such as reliable conductivity).

Furthermore, when the first flexible conductive piece 3, the second flexible conductive piece 4, the third flexible conductive piece 5 and the fourth flexible conductive piece 6 are piled together, the first flexible arches 323 of the first flexible conductive piece 3 are received in the first slots 423 of the second flexible conductive piece 4, and the second flexible arches 623 of the fourth flexible conductive piece 6 are received in the second slots 523 of the third flexible conductive piece 5. Thus, when the pin portions of the bridging terminal 1 is inserted into the opening 71 of the terminal rail 7 with the pin portions slight deformed to fit the opening 71, the deformations in Directions C and D are allowed to happen in the designed intervals (i.e. the interval between each pair of the front-left-outer facet 321 and the front-right-outer facet 322 of the first flexible conductive piece 3, and the interval between each pair of the rear-left-outer facet 621 and the rear-right-outer facet 622 of the fourth flexible conductive piece 6). Meanwhile, since the first flexible arches 323 are received in the first slots 423, and the second flexible arches 623 are received in the second slots 523, the bridging terminal 1 is protected from elastic fatigue(fatigue deformation) caused by excess external force, thereby being ensured with a long service life.

Referring back to FIG. 1, in the present embodiment, the cap 2 has two opposite recessed portions 22, for users' easy holding. With the recessed portions 22, users can easily exert force on the cap 2, so as to hold and remove the bridging terminal 1.

As shown in FIG. 4 and FIG. 5, in the present embodiment, the first slots 423 of the second flexible conductive piece 4 each have a T-shaped cross-section. Similarly, the second slots 523 of the third flexible conductive piece 5 also each have a T-shaped cross-section. Of course, the shape of the cross-section is not limited thereto.

Figure 7:
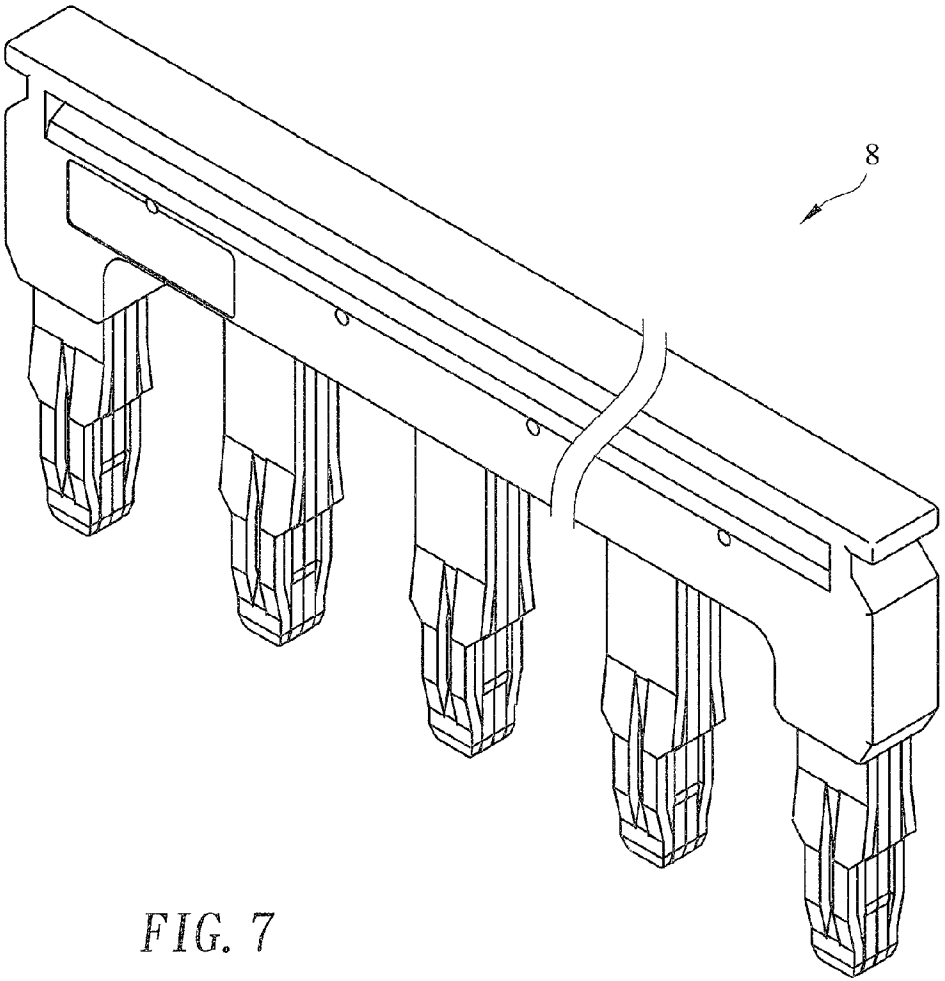
FIG. 7 is a perspective view of a second preferred embodiment of the present invention.

Referring to FIG. 7, a perspective view of a second preferred embodiment of the present invention is as shown.

The present embodiment is similar to the first preferred embodiment in terms of configuration, except that the bridging terminal 8 shown in FIG. 7 has five pin portions on each flexible conductive piece. It is to be understood that the amount of the pin portions of the flexible conductive piece is subject to the practical needs (such as two as described in the first preferred embodiment, or three, or four, or five as shown in the second preferred embodiment, or six). This design can also provide the functions of the first preferred embodiment as stated above.

What is claimed is:

1. A bridging terminal, comprising:

a cap, containing an assembling chamber;

a first flexible conductive piece, being a reversed-U shaped member that comprises a first connecting portion and at least two first pin portions, the first connecting portion serving to connect the at least two first pin portions, and each said first pin portion having a front-left-outer facet and a front-right-outer facet jutting frontward and further having a first flexible arch jutting backward, wherein the front-left-outer facet and the front-right-outer facet are at two opposite ends of the first flexible arch;

a second flexible conductive piece, being a reversed-U shaped member that comprises a second connecting portion and at least two second pin portions, the second connecting portion serving to connect the at least two second pin portions, and each said second pin portion having a first left-outer facet and a first right-outer facet and further having a first slot;

a third flexible conductive piece, being a reversed-U shaped member that comprises a third connecting portion and at least two third pin portions, the third connecting portion serving to connect the at least two third pin portions, and each said third pin portion having a second left-outer facet and a second right-outer facet and further having a second slot; and a fourth flexible conductive piece, being a reversed-U shaped member that comprises a fourth connecting portion and at least two fourth pin portions, the fourth connecting portion serving to connect the at least two fourth pin portion, and each said fourth pin portion having a rear-left-outer facet and a rear-right-outer facet jutting backward and further having a second flexible arch jutting frontward, wherein the rear-left-outer facet and the rear-right-outer facet are at two opposite ends of the second flexible arch, wherein, the first flexible conductive piece, the second flexible conductive piece, the third flexible conductive piece and the fourth flexible conductive piece are aligned and piled together such that the first connecting portion, the second connecting portion, the third connecting portion and the fourth connecting portion are correspondingly piled and combined in the assembling chamber, while the at least two first pin portions, the at least two second pin portions, the at least two third pin portions and the at least two fourth pin portions are also correspondingly piled in order to make the first flexible arches received in the first slots, and the second flexible arches are received in the second slots.

2. The bridging terminal of claim 1, wherein the cap has two opposite recessed portions.

3. The bridging terminal of claim 1, wherein the first slot has a T-shaped cross-section.

4. The bridging terminal of claim 1, wherein the second slot has a T-shaped cross-section.

* * * * *